US008197019B2

(12) United States Patent
Kim

(10) Patent No.: US 8,197,019 B2
(45) Date of Patent: Jun. 12, 2012

(54) REFRIGERATOR BODY AND METHOD OF MANUFACTURING THE SAME

(75) Inventor: Yun Ho Kim, Chang-won-si (KR)

(73) Assignee: LG Electronics Inc., Seoul (KR)

( * ) Notice: Subject to any disclaimer, the term of this patent is extended or adjusted under 35 U.S.C. 154(b) by 690 days.

(21) Appl. No.: 11/628,457

(22) PCT Filed: Jan. 19, 2005

(86) PCT No.: PCT/KR2005/000175
§ 371 (c)(1),
(2), (4) Date: Mar. 19, 2007

(87) PCT Pub. No.: WO2005/078365
PCT Pub. Date: Aug. 25, 2005

(65) Prior Publication Data

US 2008/0048540 A1 Feb. 28, 2008

(30) Foreign Application Priority Data

Feb. 11, 2004 (KR) ..... 10-2004-0009065

(51) Int. Cl.
*A47B 96/02* (2006.01)

(52) U.S. Cl. ..... 312/408; 312/401

(58) Field of Classification Search ..... 312/401, 312/406, 408, 407, 351, 410; 62/298, 382, 62/440; 248/220.31, 235, 239; 411/15, 84, 411/301
See application file for complete search history.

(56) References Cited

U.S. PATENT DOCUMENTS 1,291,321 A * 1/1919 Whittier et al. ..... 248/239
1,997,793 A * 4/1935 Hull et al. ..... 312/408
(Continued)

FOREIGN PATENT DOCUMENTS

| | | |
|---|---|---|
| DE | 296 16 623 | 11/1996 |
| EP | 0 582 781 | 2/1994 |
| FR | 2 472 150 | 6/1981 |

(Continued)

OTHER PUBLICATIONS

European Office Action issued in EP Application No. 05721825.7 dated Mar. 19, 2010.

*Primary Examiner* — James O Hansen
(74) *Attorney, Agent, or Firm* — KED & Associates, LLP

(57) ABSTRACT

The present invention relates to a refrigerator body and a method of manufacturing the same. The refrigerator body of the present invention includes an outer case for defining an external appearance and an inner case for defining the interior of a refrigerator and has a foam insulation material filled into a space between the outer and inner cases. The refrigerator body also comprises recessed portions depressed at the inside of the inner case and protruding outside thereof in a direction of thickness of the inner case so as to fix a part to be installed and mounted on the inside of the inner case, and reinforcement members installed to be tightly coupled to the recessed portions at the outside of the inner case so as to reinforce the recessed portions. Accordingly, a foaming preparation operation can be rapidly and easily performed, and the foam insulation material can be prevented from leaking into the interior of the refrigerator.

5 Claims, 5 Drawing Sheets

U.S. PATENT DOCUMENTS

| | | | | | |
|---|---|---|---|---|---|
| 2,852,329 | A | * | 9/1958 | Smith | 312/351 |
| 3,669,520 | A | * | 6/1972 | Jansen | 312/351 |
| 4,067,256 | A | * | 1/1978 | Turner | 411/437 |
| 4,107,833 | A | * | 8/1978 | Knight et al. | 29/460 |
| 4,195,888 | A | * | 4/1980 | Squire | 312/408 |
| 5,199,778 | A | * | 4/1993 | Aoki et al. | 312/408 |
| 5,486,045 | A | * | 1/1996 | Dasher | 312/406 |
| 5,692,817 | A | * | 12/1997 | Jun et al. | 312/408 |
| 5,855,424 | A | * | 1/1999 | Hamilton et al. | 312/408 |

FOREIGN PATENT DOCUMENTS

| | | |
|---|---|---|
| JP | 6213559 | 8/1994 |
| JP | 9250870 | 9/1997 |
| JP | 11-118336 | 4/1999 |
| KR | 20-1997-0005935 | 6/1997 |
| KR | 20-1998-067370 | 12/1998 |
| KR | 20-0290174 | 11/2002 |
| KR | 10-0578370 | 5/2006 |

* cited by examiner

[FIG.1]
PRIOR ART
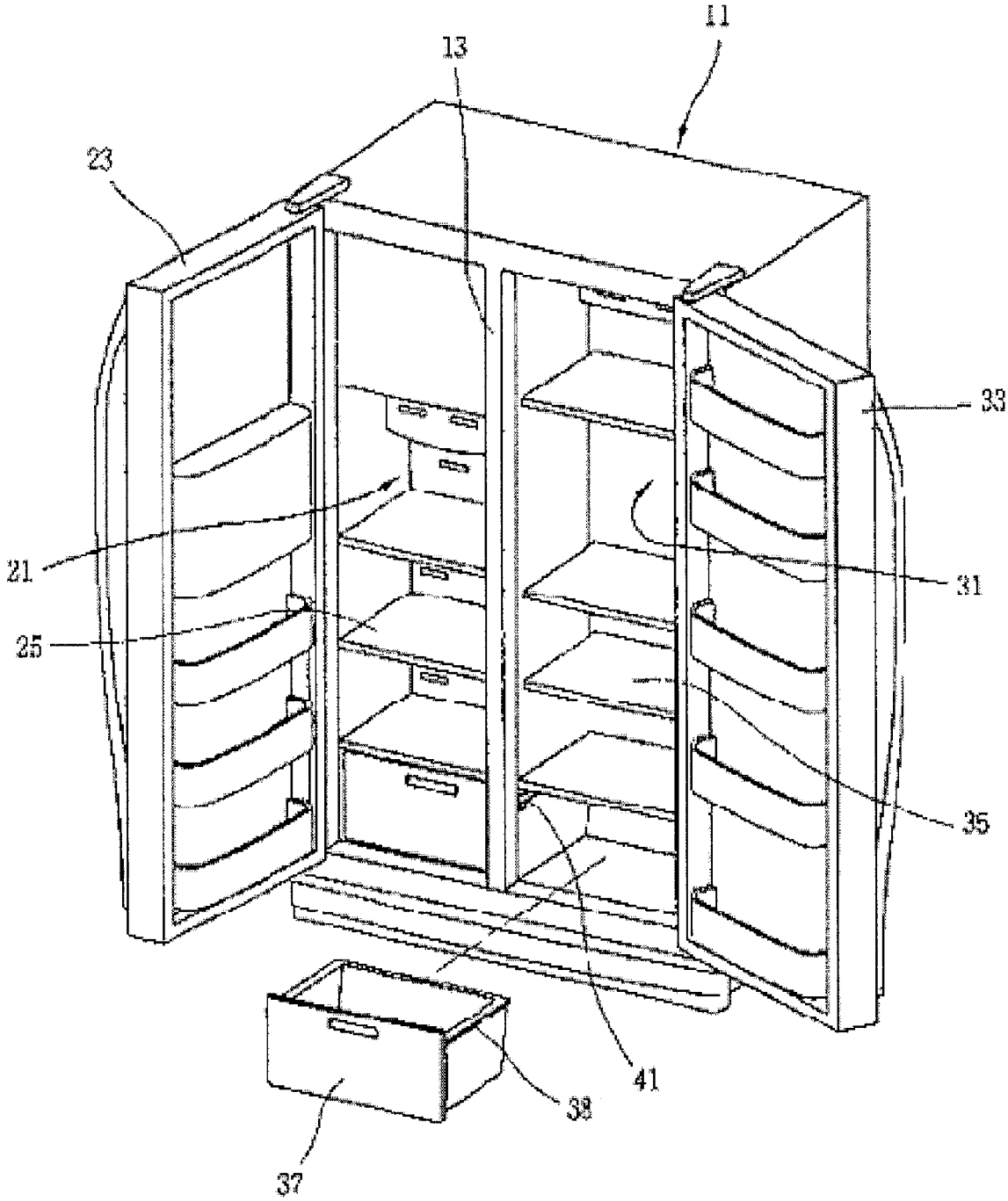

[FIG.2]
PRIOR ART
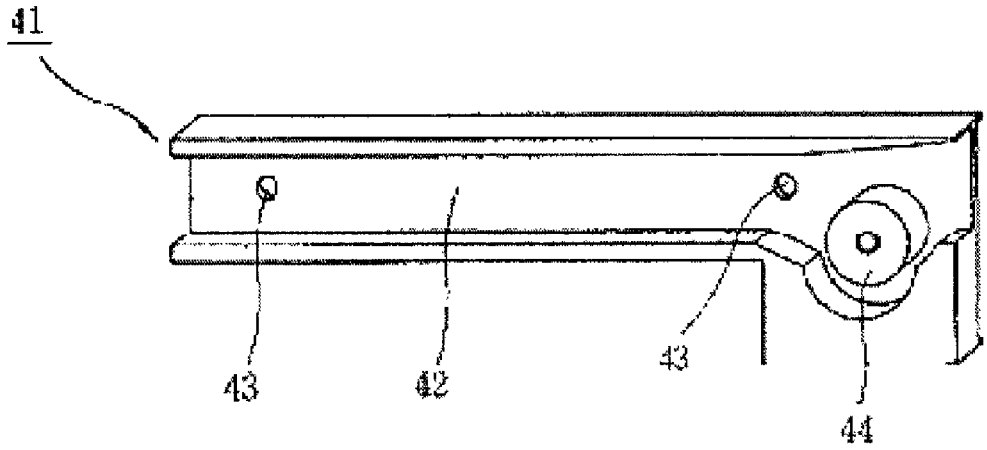

[FIG. 3]
PRIOR ART
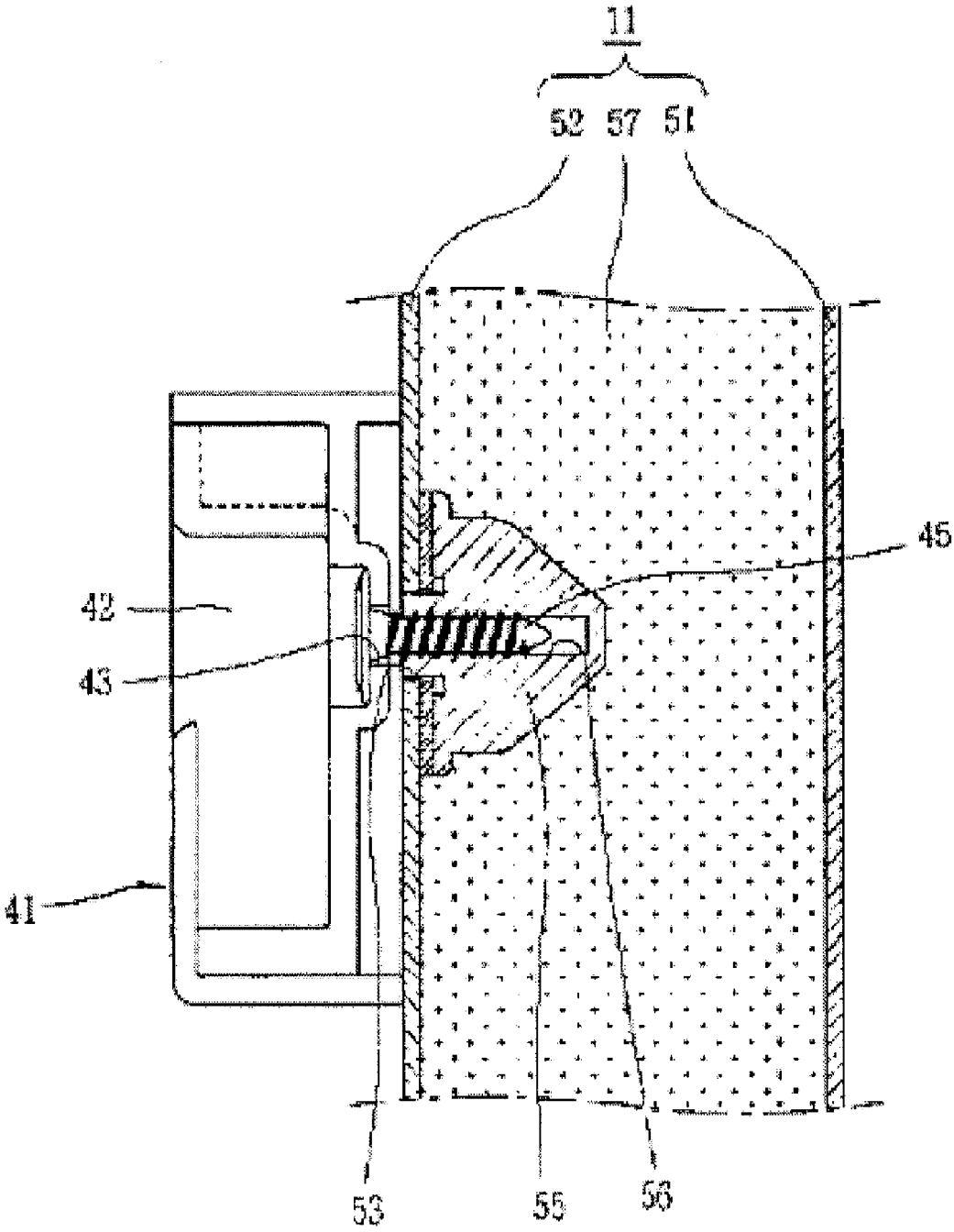

[Fig. 4]
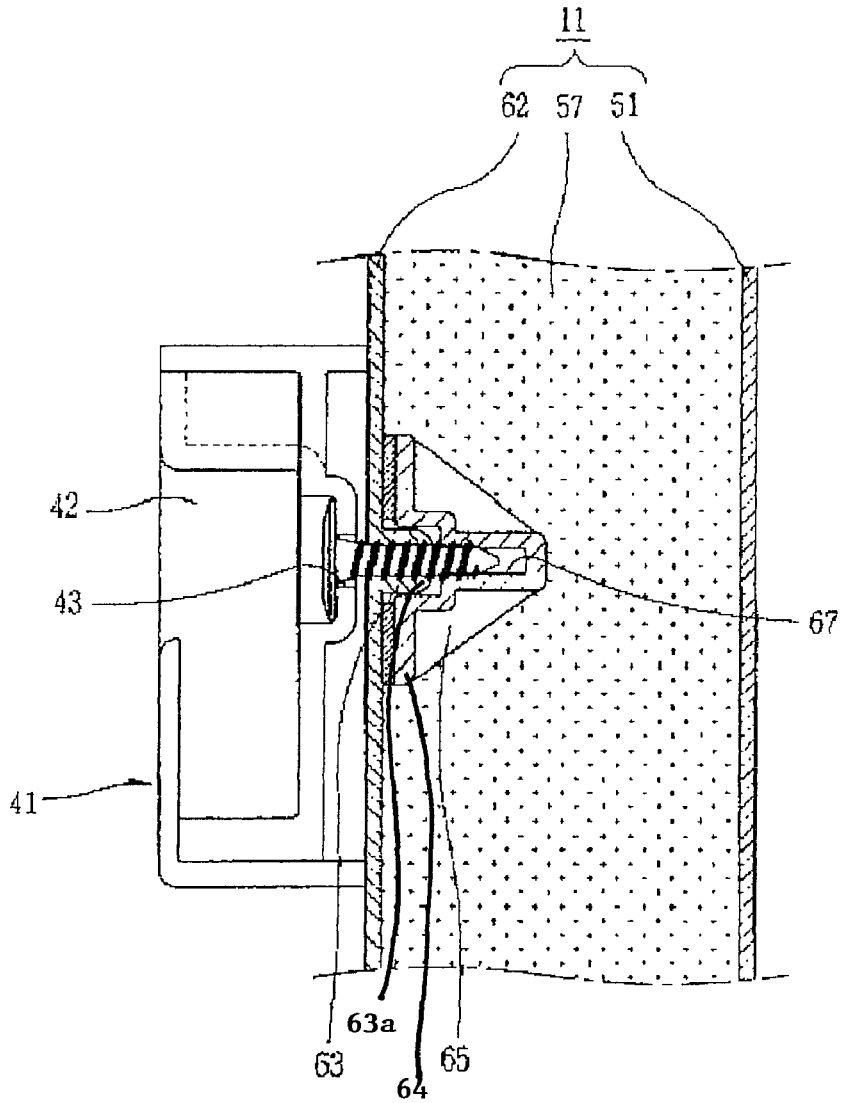
[Fig. 5]
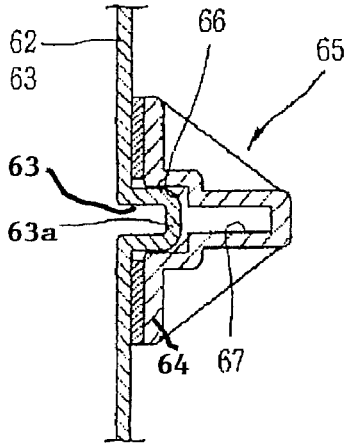

[Fig. 6]
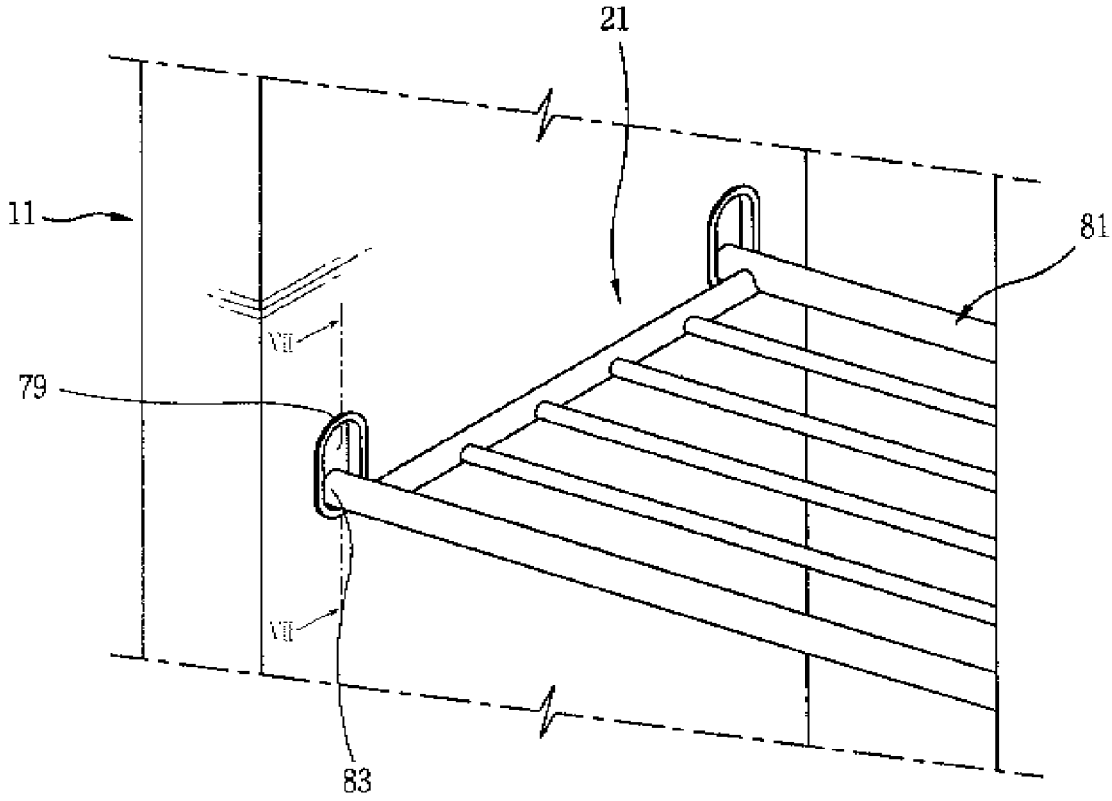
[Fig. 7]
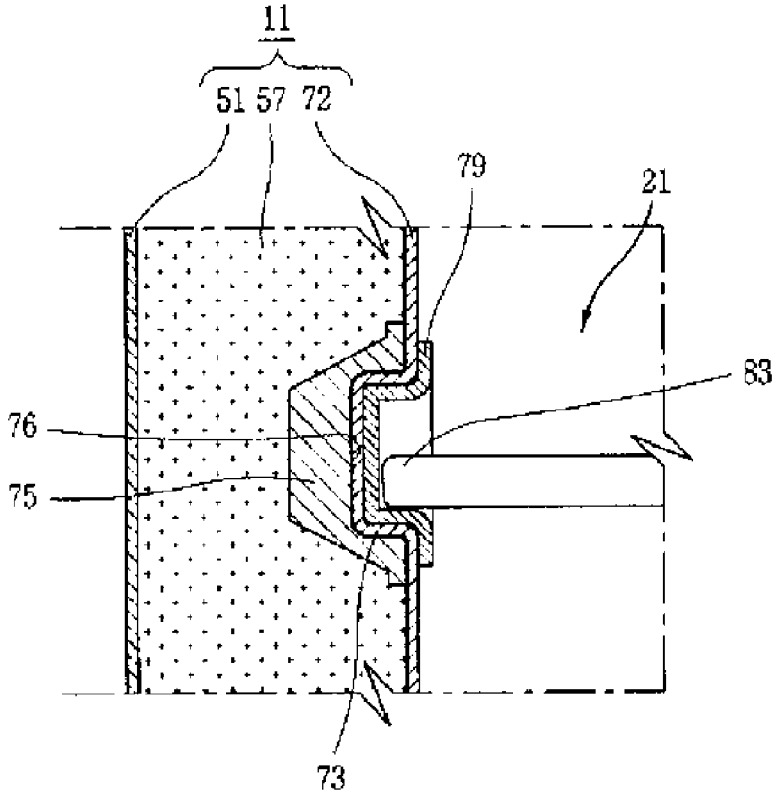

REFRIGERATOR BODY AND METHOD OF MANUFACTURING THE SAME

TECHNICAL FIELD

The present invention relates to a refrigerator body and a method of manufacturing the same, and more particularly, to a refrigerator body and a method of manufacturing the same, wherein a foaming preparation operation can be rapidly and easily performed and a foam insulation material is prevented from leaking into the interior of a refrigerator.

BACKGROUND ART

FIG. 1 is a perspective view of a conventional refrigerator, FIG. 2 is a front view of a guide rail shown in FIG. 1, and FIG. 3 is a partial sectional view of a region where the guide rail shown in FIG. 1 is installed. As shown in these figures, the refrigerator comprises a body 11 with a freezing chamber 21 and a refrigerating chamber 31 formed at both sides of a vertically arranged partition 13, and a freezing chamber door 23 and a refrigerating chamber door 33 hingedly coupled to the body 11 to open and close front openings of the freezing and refrigerating chambers 21 and 31, respectively.

The interiors of the freezing and refrigerating chambers 21 and 31 are provided with a plurality of shelves 25 and 35 arranged at vertical intervals to be spaced apart from one another, for partitioning inner spaces of the chambers and simultaneously supporting stored goods thereon.

A drawer 37, which can be taken out in a fore and aft direction, is provided at a lower region of the refrigerator 31. Both side edges of the drawer 37 are formed with flanges 38 that protrude widthwise and extend in the fore and aft direction.

Guide rails 41 are installed on both sidewalls of the refrigerating chamber 31 to extend in the fore and aft direction, thereby guiding the withdrawal and reception of the drawer 37 from and in the refrigerating chamber. Each of the guide rails 41 is formed with a receiving groove 42 such that the corresponding flange 38 of the drawer 37 can be received in and engaged with the receiving groove. Screw holes 43 are formed through the guide rails within the receiving grooves 42 so that the guide rails 41 can be fastened to the both sidewalls of the refrigerating chamber 31 by means of screws 45. Rollers 44 are provided at front regions of the guide rails to be in rolling contact with the flanges 38 of the drawer 37.

Meanwhile, the body 11 comprises an outer case 51 for defining an external appearance, and an inner case 52 for defining the freezing and refrigerating chambers 21 and 31 arranged inside the outer case 51 to be spaced apart therefrom with a filling gap that will be filled with a foam insulation material 57.

Regions on a portion of the inner case 52 defining the refrigerating chamber 31 where the guide rails 41 will be installed are formed with through-holes 53 through which the screws 45 penetrate. A bushing 55 embedded in the wall of the refrigerator body is inserted into and coupled to each of the through-holes 53 at a side of the bushing. The bushing 55 is formed with a screw hole 56 through which the screw 45 is inserted.

However, such a conventional refrigerator has a problem in that since the bushings 55 should be inserted into and coupled to the respective through-holes 53 and a foaming operation should be performed by injecting the foam insulation material 57 in the form of liquid into the space between the inner and outer cases 52 and 51, the foam insulation material 57 leaks into the interior of the refrigerator through the through-holes 53 during the foaming operation. If tapes are attached around the bushings 55 in consideration of this problem, there are problems in that it takes a great deal of time and efforts to prepare the foaming operation and the leak of the foam insulation material 57 into the interior of the refrigerator through the through-holes 53 cannot be fundamentally avoided.

DISCLOSURE OF INVENTION

Technical Problem

Accordingly, an object of the present invention is to provide a refrigerator body and a method of manufacturing the same, wherein a foaming preparation operation can be rapidly and easily performed, a foam insulation material is prevented from leaking into the interior of a refrigerator, availability of the interior of the refrigerator is improved since a part of a shelve can be supported by the refrigerator body, and workability is also enhanced since fastening positions are guided upon installation of reinforcement members on the exterior of an inner case or assembly of interior materials on the inner case.

Technical Solution

According to an aspect of the present invention for achieving the object, there is provided a refrigerator body including an outer case for defining an external appearance and an inner case for defining the interior of a refrigerator and having a foam insulation material filled into a space between the outer and inner cases, comprising recessed portions depressed at the inside of the inner case and protruding outside thereof in a direction of thickness of the inner case so as to fix a part to be installed and mounted on the inside of the inner case; and reinforcement members installed to be tightly coupled to the recessed portions at the outside of the inner case so as to reinforce the recessed portions.

Preferably, the reinforcement members are formed with screw holes to which screws that have passed through the recessed portions can be coupled.

The refrigerator body may advantageously further comprise protrusion holders received in recessed sections of the recessed portions on the side of a refrigerating chamber of the refrigerator so as to receive and support fixing protrusions of a shelf.

According to another aspect of the present invention, there is provided a method of manufacturing a refrigerator body, comprising the steps of forming an inner case such that the inner case has recessed portions depressed at the inside of the inner case and protruding outside thereof in a direction of thickness of the inner case; coupling reinforcement members to the recessed portions at the outside of the inner case; arranging an outer case outside the inner case with a filling gap for a foam insulation material therebetween; and foaming and filling the foam insulation material between the inner and outer cases.

Preferably, after the step of foaming and filling the foam insulation material, the method further comprises the step of fastening an article to the reinforcement members by means of screws so as to fix the article to the inside of the inner case.

Advantageous Effects

According to the present invention described above, in order to fix an article to be installed and mounted on the inside of an inner case, the inner case is formed with recessed portions depressed at the inside of the inner case and protruding outside thereof in a direction of thickness of the inner case, and reinforcement members are provided to be tightly coupled to the recessed portions at the outside of the inner case. Thus, there are advantages in that such a foaming preparation operation can be rapidly and easily performed, and a foam insulation material can be prevented from leaking into the interior of a refrigerator.

Further, since the recessed portions are depressed at one side of the inner case and outwardly protrude at the other side thereof, it is possible to find mounting positions of the reinforcement members and interior materials, thereby improving assemblability.

Moreover, according to the refrigerator body and the method of manufacturing the same according to the present invention, since it is not necessary to beforehand form screw holes on the inner case, there are advantages in that the assembly and structural performance of the product can be improved and leak of a foam insulation material can be fundamentally prevented upon fastening of interior materials.

BRIEF DESCRIPTION OF THE DRAWINGS

The above and other objects, features and advantages of the present invention will become apparent from the following description of preferred embodiments given in conjunction with the accompanying drawings, in which:

FIG. 1 is a perspective view of a conventional refrigerator;

FIG. 2 is a front view of a guide rail shown in FIG. 1;

FIG. 3 is a partial sectional view of a region where the guide rail shown in FIG. 1 is installed;

FIG. 4 is an enlarged view showing essential portions of a refrigerator body according to an embodiment of the present invention;

FIG. 5 is a sectional view illustrating a coupled state of a reinforcement member shown in FIG. 4;

FIG. 6 is an enlarged view showing essential portions of a refrigerator body according to another embodiment of the present invention; and FIG. 7 is a sectional view taken along line VII-VII of FIG. 6.

BEST MODE FOR CARRYING OUT THE INVENTION

Hereinafter, the present invention will be described in detail with reference to the accompanying drawings.

FIG. 4 is an enlarged view showing essential portions of a refrigerator body according to an embodiment of the present invention, and FIG. 5 is a sectional view illustrating a coupled state of a reinforcement member shown in FIG. 4. For the sake of convenience of description of the drawings, illustration of parts identical or substantially identical with the structures illustrated and described above will be omitted and the like parts are designated by like reference numerals. As shown in these figures, the refrigerator body 1 of this embodiment comprises an outer case 51 for defining an external appearance; an inner case 62 that is arranged inside the outer case 51 to be spaced apart therefrom with a filling gap for a foam insulation material 57 therebetween and is formed with recessed portions 63 depressed at one side of the inner case and protruding at the other side thereof in a direction of thickness of the refrigerator body so as to support an object; and reinforcement members 65 coupled to the recessed portions 63 to reinforce the recessed portions 63.

In each of regions on the inner case 62 where guide rails 41 are installed, each of the recessed portions 63 is formed by being depressed from a refrigerating chamber 31 to protrude outside the refrigerating chamber 31 in the direction of thickness of the refrigerator body. The reinforcement member 65 implemented in the form of a bushing is coupled at the rear of the recessed portion 63 so that a screw 45 is coupled to the reinforcement member and the reinforcement member can reinforce the strength of the recessed portion 63. The reinforcement member 65 is formed with a recessed, receiving portion 66 for accommodating a protruding section of the recessed portion 63 and a flange 64 that extends outward from the receiving portion 66. A screw hole 67 into which a leading end of the screw 45 is inserted and coupled is formed at a side of the receiving portion 66 on a line of insertion of the screw 45.

With such a structure, the inner case 62 is first formed to have the recessed portions 63 depressed at the inside of the inner case to protrude outside the inner case in the direction of thickness of the refrigerator body, and the receiving portions 66 of the reinforcement members 65 are then coupled, at the outside of the inner case 62, to the protruding sections of the respective recessed portions 63 of the inner case 62. Subsequently, the outer case 51 is arranged outside the inner case 62 to be spaced apart therefrom with a filling gap for the foam insulation material 57 therebetween. Thus, such a foaming preparation operation can be rapidly and easily performed. When the foaming preparation operation has been completed, a foaming operation is performed by injecting the foam insulation material 57 in the form of liquid into the space between the inner and outer cases 62 and 51.

Meanwhile, when the guide rails 41 are intended to be installed, the screw holes 43 of each of the guide rails 41 should be placed over the respective recessed portions 63, and each of the screws 45 is fastened by being inserted and pressed into the corresponding screw hole 43 such that the leading end of the screw 45 penetrates through a terminal end wall 63*a* of the corresponding recessed portion 63. The screw 45 that has penetrated through the recessed portion 63 and terminal end wall 63*a* is fastened to the screw hole 67 of the reinforcement member 65 so that the guide rail 41 is integrally fixed to an inner wall of the inner case 62.

FIG. 6 is an enlarged view showing essential portions of a refrigerator body according to another embodiment of the present invention, and FIG. 7 is a sectional view taken along line VII-VII of FIG. 6. As shown in these figures, the refrigerator body 11 comprises an outer case 51 for defining an external appearance; an inner case 72 that is arranged inside the outer case 51 to be spaced apart therefrom with a filling gap for a foam insulation material 57 therebetween and is formed with recessed portions 73 depressed from a freezing chamber 21 and protruding outside the freezing chamber 21; reinforcement members 75 coupled, at the outside of the inner case 72, to the recessed portions 73 to reinforce the strength of the recessed portions 73; and protrusion holders 79 inserted into and coupled to recessed regions of the inner case on the side of the freezing chamber 21 to receive and support fixing protrusions 83 of shelves 81.

The rectangular shelves 81 made of wires are installed within the freezing chamber 21, and each of the shelves 81 is formed, at corner regions of both side edges thereof, with the plurality of fixing protrusions 83 protruding widthwise thereof.

Meanwhile, the plurality of recessed portions 73 depressed from the freezing chamber 21 and protruding outside the freezing chamber 21 are formed at regions of the inner case 72 where the shelves 81 are installed. Each of the reinforcement members 75 with a receiving portion 76 formed at one side thereof to receive a protruding section of each of the recessed portions 73 is coupled to the protruding section of the recessed portion 73. Each of the protrusion holders 79, which has one side depressed to receive the fixing protrusion 83 of one of the shelves 81 and the other side protruding to be inserted into the recessed portion 73, is inserted into and coupled to the recessed regions of the inner case 72 on the side of the freezing chamber 21.

With such a structure, the inner case 72 is formed to have the recessed portions 73 depressed at the inside of the inner case to protrude outside the inner case in the direction of thickness of the refrigerator body, and the reinforcement members 75 are coupled, at the outside of the inner case 72, to the protruding sections of the respective recessed portions 73. Subsequently, the outer case 51 is arranged outside the inner case 72 to be spaced apart therefrom with the filling gap for the foam insulation material 57 therebetween.

When the foaming preparation operation has been completed, a foaming operation is performed by injecting the foam insulation material 57 in the form of liquid into the space between the inner and outer cases 72 and 51, and the protrusion holder 79 is inserted into the recessed portion 73 to be coupled thereto.

Meanwhile, each shelf 81 is installed in such a manner that the respective fixing protrusions 83 thereof is received in and supported by the protrusion holders 79.

Although the refrigerator body and the method of manufacturing the same according to the present invention have been described above by way of example with reference to the accompanying drawings, the present invention is not limited to the embodiments described above and the drawings. It will be apparent that those skilled in the art can make various modifications thereto within the scope and basic technical spirit of the present invention. The scope of the present invention should be construed based on the appended claims.

The invention claimed is:

1. A refrigerator body including an outer case that defines an external surface and an inner case that defines an interior compartment of a refrigerator and having a foam insulation material filled into a space between the outer and inner cases, comprising:

a plurality of recessed portions formed as depressions in an inner surface of the inner case, each of the plurality of recessed portions forming a corresponding protruding portion that protrudes outward from the inner case toward the outer case and a terminal end wall which is forcibly penetrated by a screw passing through the corresponding protruding portion; and a corresponding plurality of reinforcement members respectively coupled to the plurality of recessed portions at an outer side of the inner case so as to reinforce the plurality of recessed portions, wherein each of the plurality of reinforcement members includes:

a recessed receiving portion that is fitted around a corresponding protruding portion of a respective recessed portion;

a screw hole portion that protrudes longitudinally outward from a first end of the recessed receiving portion, a proximal end of the screw hole portion being open so as to receive the screw that has passed through a corresponding opening in the first end of the recessed receiving portion, and a terminal end of the screw hole portion being closed; and a flange that extends radially outward from a circumferential edge of a second end of the recessed receiving portion opposite the first end thereof, the flange being substantially parallel to a corresponding surface of the inner case, wherein each screw passes through a respective recessed portion and is then fastened to a respective reinforcement member, wherein each screw forms threads on an inner circumferential surface of its respective protruding portion and forms a penetration hole through its respective terminal end wall, and forms threads on an inner circumferential surface of its respective screw hole portion.

2. The refrigerator body as claimed in claim 1, wherein the recessed receiving portion of each of the plurality of reinforcement members is shaped such that the protruding portion of a corresponding recessed portion of the plurality of recessed portions is fitted and held therein.

3. The refrigerator body as claimed in claim 1, wherein the plurality of reinforcement members substantially surround the protruding portions of the corresponding plurality of recessed portions.

4. The refrigerator body as claimed in claim 1, wherein the plurality of recessed portions comprises:

a plurality of first recessed portions formed in a first inner side wall surface of the inner case;

a plurality of second recessed portions formed in a second inner side wall surface of the inner case, wherein the second inner side wall surface is opposite the first inner side wall surface, and wherein the plurality of first and second recessed portions are respectively positioned at corresponding heights.

5. A refrigerator, comprising:

an inner case positioned within an outer case;

an insulation material filled within a space formed between the inner and outer cases;

a plurality of first recessed portions formed as recesses in a first inner side wall surface of the inner case such that each of the first recessed portions includes a corresponding protrusion portion that extends outward from an outer side of the inner case toward the outer case and a terminal end wall which is forcibly penetrated by a screw passing through the corresponding protrusion portion;

a plurality of second recessed portions formed as recesses in a second inner side wall surface of the inner case that faces the first inner side wall case such that each of the second recessed portions includes a corresponding protrusion portion that extends outward from an outer side of the inner case toward the outer case and a terminal end wall which is forcibly penetrated by a screw passing through the corresponding protrusion portion; and a plurality of reinforcement members, each comprising:

a recessed receiving portion that receives a corresponding protrusion portion therein so as to substantially surround the corresponding protrusion portion and reinforce the plurality of first and second recessed portions;

a screw hole portion that protrudes longitudinally outward from an open first end of the recessed receiving portion, a proximal end of the screw hole portion being open corresponding to the open first end of the recessed receiving portion, and a terminal end of the screw hole portion being closed; and a flange that extends radially outward from a circumferential edge of a second end of the recessed receiving portion opposite the first end thereof, wherein the screw passes through a respective recessed portion and is then fastened to a respective reinforcement member, wherein the screw forms threads on an inner circumferential surface of its respective protruding portion and forms a penetration hole through its respective terminal end wall, and forms threads on an inner circumferential surface of its respective screw hole portion.

* * * * *